US008935900B2

(12) United States Patent
Holthusen

(10) Patent No.: US 8,935,900 B2
(45) Date of Patent: Jan. 20, 2015

(54) REINFORCEMENT RETAINER

(71) Applicant: Robin Holthusen, London (GB)

(72) Inventor: Robin Holthusen, London (GB)

( * ) Notice: Subject to any disclaimer, the term of this patent is extended or adjusted under 35 U.S.C. 154(b) by 0 days.

(21) Appl. No.: 14/138,547

(22) Filed: Dec. 23, 2013

(65) Prior Publication Data

US 2014/0190116 A1 Jul. 10, 2014

(30) Foreign Application Priority Data

Jan. 4, 2013 (GB) ..... 1300122.7

(51) Int. Cl.
*E04C 5/16* (2006.01)

(52) U.S. Cl.
CPC ..... *E04C 5/167* (2013.01); *E04C 5/168* (2013.01)
USPC ..... 52/684; 52/677; 52/707

(58) Field of Classification Search
CPC ..... E04C 5/16; E04C 5/166; E04C 5/167; E04C 1/39; E04C 5/20; E04C 5/206; E04G 21/125
USPC ..... 52/378, 379, 431, 565, 633, 677, 684, 52/686, 706, 707, 719
See application file for complete search history.

(56) References Cited

U.S. PATENT DOCUMENTS

| | | | | |
|---|---|---|---|---|
| 3,292,335 | A * | 12/1966 | Stober | 52/677 |
| 4,107,895 | A | 8/1978 | LeGrady | |
| 5,371,991 | A * | 12/1994 | Bechtel et al. | 52/686 |
| 7,007,436 | B1 | 3/2006 | Kelley | |
| 2002/0112437 | A1 | 8/2002 | Queen | |
| 2005/0133684 | A1 | 6/2005 | Maguire | |
| 2006/0272259 | A1 | 12/2006 | Ryder | |
| 2010/0212247 | A1 * | 8/2010 | Kohl et al. | 52/565 |
| 2011/0047915 | A1 * | 3/2011 | Waters et al. | 52/414 |

FOREIGN PATENT DOCUMENTS

| | | |
|---|---|---|
| AU | WO2009/012519 | 1/2009 |
| EP | WO2013143585 | 10/2013 |
| GB | 2037862 | 12/1978 |

OTHER PUBLICATIONS

First Examination Report received in New Zealand IP No. 619400 dated Jan. 7, 2014.
Further Examination Report received in New Zealand IP No. 617400 dated Jun. 27, 2014.
Further Examination Report received in New Zealand IP No. 617400 dated Jul. 22, 2014.

* cited by examiner

*Primary Examiner* — Charles A Fox
*Assistant Examiner* — Patrick Maestri
(74) *Attorney, Agent, or Firm* — William H. Bollman

(57) ABSTRACT

A reinforcement retainer in the form of a resilient insert for maintaining at least one construction reinforcement member within an aperture in a construction component such as a building block or a brick. The insert is an elongate body with distal ends and is proportioned to be received within the opening. Flexible feet are located at the distal ends and are capable of deformation to press on inner faces of the aperture to adjust the location of one or more reinforcement members prior to setting in concrete slurry. The insert defines at least one stay arranged in use to support one of the reinforcement members.

3 Claims, 6 Drawing Sheets

REINFORCEMENT RETAINER

FIELD OF THE INVENTION

The present invention relates to a reinforcement retainer in the form of an insert for maintaining at least one construction reinforcement member in a desired position within an apertured construction component such as a building block or a brick.

BACKGROUND

When building reinforced structures it is common for a metal lattice or steels to be positioned within masonry to provide reinforcement. Typically reinforcement members are positioned within apertured masonry blocks before the addition of poured concrete which sets the reinforcement members and blocks in place.

However, the reinforcement members may not be positioned centrally or may move during pouring of the concrete so that the reinforcement may not be uniform which may compromise strength and longevity. Reinforcement members may be pushed out of place when concrete is poured rendering structural calculations useless as well as potentially compromising the integrity of the structure.

Some masonry may include guide portions for locating reinforcement members, for example a defined channel. However, this may substantially increase the costs of the masonry and therefore may be undesirable.

PRIOR ART

A number of patent applications have proposed to resolve the problem, including the following:

United States patent application US 2005 133 684 (MAGUIRE) discloses a device for supporting a vertical 'rebar' in preparation for pouring concrete into an area framed by a wooden frame member.

United Kingdom patent application GB 2 037 862 (LEUNG YAT SHING) discloses a method of making a reinforced concrete structure which includes a number of metal reinforcing rods positioned relative one another by clips between pairs of reinforcing rods.

U.S. Pat. No. 4,107,895 (LeGrady) discloses, in a reinforcing bar locating means, a single piece of wire having an S-shaped portion disposed to overly a vertical opening between said side walls of a respective concrete block.

International patent application WO-A1-2009012519 (Block-Aid Pty Ltd) relates to a block wall system for positioning reinforcement bars in a block wall comprising a bracket for locating a longitudinal reinforcement bar within a block wall.

International patent application WO-A1-2013143585 (Velasco) relates to joiner plates positioned between blocks. The joiner plates are provided with vertical holes for mounting vertical bars that secure the blocks.

United States patent application US-A1-2002112437 (Queen) proposes a positioning device for positioning a reinforcement bar with a masonry block.

United States patent application US-A1-20060272259 (Ryder) proposes building blocks and location devices for reinforced concrete walls.

U.S. Pat. No. 7,007,436 B1 (Kelley) proposes a building block having internal support brackets for reinforcement members.

While the above prior art relates to positioning long reinforcement members within construction blocks, each device suffers from drawbacks. Some clips, brackets, location devices, and joiner plates referred to have been difficult or cumbersome to use when the reinforcement members are already in place in an assembly of construction blocks.

The present invention aims to overcome disadvantages associated with prior art inserts.

SUMMARY OF THE INVENTION

According to one aspect of the present invention is a reinforcement retainer in the form of a resilient insert proportioned to fit within an aperture in a construction component and defining a stay shaped to receive and support a reinforcement member in an adjusted position within the aperture, said insert having flexible feet at its distal ends to press on inner faces of the aperture with sufficient friction to locate the reinforcement member in its adjusted position whilst capable of being flexed to accommodate apertures of different distances sizes.

An advantage of the present insert is its capacity to be located with sufficient friction against walls of the opening of a single brick or building block and to be located with sufficient friction against walls of an opening formed by an assembly of such bricks or blocks. Unlike some existing inserts which are made for a specific size of opening of a block formed before the block arrives at construction site, the length of the present insert is variable to accommodate the size of openings in different blocks present on the construction site and to accommodate openings in assemblies of blocks built up on the construction site.

An opening in a brick, construction or building block may be described as an aperture or a lacuna.

Ideally the insert maintains at least one construction reinforcement member within a opening provided by a block; the insert may comprise an elongate body with distal ends, in which said insert is arranged in use to be received with the opening and said ends comprise portions capable of deformation, and wherein said body is further arranged with at least one stay arranged in use to engage the member(s).

The at least one stay may be arranged in use to grip a reinforcement member. An advantage of this is that the insert is urged in use into the opening provided by a block and the reinforcement member engages the stay on the body so that the reinforcement member is held in a desired position and orientation within the opening. When in use a force acts upon ends of the insert as the ends are compressed between the walls of the block so as to maintain the insert and hold a reinforcement member in a desired location.

The insert may comprise: a body, having at least two deformable ends, a first stay for engaging a first construction reinforcement member, and at least one second stay for engaging a second construction reinforcement member. The stays may be arranged orthogonally. The stays may be arranged in use so as to hold one tie against the other. The stay may be a catch. The stays may be arranged in use so as to advantageously maintain the reinforcement members in cooperation and so as to increase and aid in stability of a resultant structure.

The insert may be for use in masonry and in particular within masonry or concrete blocks so as to enable the securement of reinforcement members within the blocks before addition of poured concrete, so as to grip and locate the reinforcement members.

Preferably the body of the insert is substantially planar and elongate and includes at least one deformable portion at each end. The insert may be fabricated from a deformable material throughout the body. Ideally the insert is formed from, or includes, a deformable portion, such as a flexible toe which readily deforms or bends on application of a force.

Optionally the insert has a portion including a profile, textured surface or material disposed on it to resist movement.

Typically the body is formed from a lightweight, durable, strong material such as a synthetic plastics material. Examples of these are as nylon, abutyl-styrene 'ABS'. Neither the body nor the insert as a whole are limited be being made from these particular example materials. Many lightweight and durable materials will suffice.

Optionally the portions are resiliently deformable portions formed from a rubber or synthetic rubber which is over moulded onto or formed integral to the body. Preferably the body is formed from a material which deforms. The insert also acts as a strengthening member and serves to enhance strength of a structure in which it is used by acting as a brace.

Typically in use therefore the insert is placed within the opening across a diagonal formed in hollow or aperture of a block wherein end portions do not touch internal walls of a block and wherein the insert is capable of being rotated so as to engage the portions with the walls.

Advantageously the portions bend when urged against the opening wall. Preferably the insert is dimensioned in order that the insert becomes wedged when nearing perpendicular to the walls in which it is in contact.

Preferably each end includes a plurality of flexible portions for example five flexible toes. Preferably the portions are provided at different lengths, differing in size from one side of the body to the other so as facilitate deformation when rotated.

Typically the portions are positioned so that the smallest portion is located at the side which is leading rotation. For example if the insert is being rotated clockwise the portions on the right side, when viewed from above, will be smallest and the portions on the opposing side will be largest.

Advantageously the use of deformable portions and in particular assorted sized figures enables the insert to be successfully fitted into masonry opening by twisting, even if the dimensions vary slightly from between, for example due to casting faults or deformities.

Preferably the stay is located on the body at an intermediate or equal distance from the ends. Preferably the stay is arranged or formed for accepting a reinforcement member typically by deforming to accept the member and reforming to grip, wherein the stay is of smaller diameter.

Ideally the arcuate stay is semi-circular with an opening to enable the reinforcement member to be accepted, typically by means of push or clip fitting. Advantageously the insert may be ideally slotted on to the reinforcement member at any point and slid down into the opening prior to twisting. Thus is not necessary to push the end of the reinforcement though a stay of the insert. There is no need to thread the end of a reinforcement member through a stay. Instead an insert engages with a side not an end of a reinforcement member. The insert comprises a stay to enable sideways engagement of a reinforcement member. The stay holds the orientation and position of the reinforcement member as desired once the sideways engagement reinforcement member is accomplished by the stay.

Ideally the reinforcement member is positioned within and through the block, for example extending from block(s) below. The insert is then clipped on to an exposed part of the reinforcement member by means of the stay. The insert is advantageously capable of rotating around the reinforcement member when clipped in place.

It may be envisaged in corresponding fashion that reinforcement members are typically cylindrical although the insert may be adapted to fit alternative reinforcement members, for example square cross-section members.

The insert is then typically lowered into the opening, being positioned and arranged to fit diagonally within the opening so that the ends of the insert do not come into contact with the opening walls when located to a desired depth (or height) with the opening. Once located within the opening the insert may be rotated or twisted to become wedged into position, typically substantially perpendicular to the walls with which it is in contact.

Preferably at least one catch comprises a resiliently deformable protrusion arranged orthogonal to the stay and on a superior or inferior face of the body or insert in use. The catch serves to retain a reinforcement member in a substantially horizontal or lateral orientation.

Preferably the catch may be formed in a semi-circular format similar or analogous to the stay or clip, wherein the catch includes a partial D- or C-shape facing orthogonal to the stay in use.

Ideally the horizontal or lateral second reinforcement member is butted up to the vertical or longitudinal first reinforcement member so as to cross formation of reinforcement members. The catch serves to hold the second reinforcement member preferably directly against the first reinforcement member so that the reinforcement members are secured in place with respect to the catch or stay.

Preferably the catch protrudes from the insert face at a distance equal to the diameter of the second reinforcement member and to a distance of at least 0.60 of the diameter of the second reinforcement member thereby ensuring the second reinforcement member is securely held in place.

Preferably the catch is dimensioned so as to provide a curved portion for accepting the second reinforcement member. Advantageously the reinforcement member-facing portion of the catch may include ridges so as limit the second reinforcement member from slipping in use. Said ridges may have an offset profile so as to limit reverse movement.

Preferably the first and second reinforcement member and stay and catch may be reversed in arrangement.

Typically the catch and stay are integrated with the body so that they may be constructed from a single mould.

Preferably the insert includes a plurality of perforations or apertures enabling permeation by concrete thereby providing superior strength and requiring less material for manufacture. Typically the apertures are in the same plane as the vertical or longitudinal reinforcement member for optimal permeation.

Preferably the body may be provided with further arms to create a substantially T-shaped or star shaped insert with more than two ends. Typically the arms extend include at least one deformable portion which may also touch the opening walls when fitted thereby providing additional stability.

Preferably the further arms may be shortened and/or used as fitting aids by a user, for aids in twisting the insert and urging the portions into the opening's walls.

Reinforcement members such as long reinforcing bars reinforce an entire wall of blocks. The insert described herein is easily engaged with two or more reinforcement members even after the reinforcement members are cemented into construction blocks previously laid, because the stays of this insert engage sideways with the reinforcement member. The insert can hold one long reinforcement member aligned with the lateral direction of the wall and another long reinforcement member aligned with the longitudinal direction of the wall simultaneously.

Reinforcement members may extend though many stacks of blocks so as to reinforce the stacks and hold them together. Lateral reinforcing bars pass through or pass by many blocks in a row. A prior art positioning insert that must be threaded over the end of a long reinforcing bar is inconvenient because the end of the bar may be a substantial distance from where the positioning insert is required. As the reinforcement member may have one end already cemented into an assembly of blocks the reinforcement member may be already fixed to the cemented block assembly. The prior art positioning insert had to be moved along the long reinforcing bar until it was in a desired position.

Threading some existing positioning inserts over the top of a long reinforcement bar was particularly problematic if the bar extends vertically or longitudinally for a long distance.

It was not always possible for a worker to reach up easily to an end of the vertical reinforcement member. The insert described herein has an advantage that it engages sideways with reinforcement members. The insert therefore does not need to be wound, slid or threaded over the top of a long vertically or longitudinally arranged bar, nor does the insert need to be threaded over an end of a long horizontally or laterally arranged bar.

The insert engages sideways easily with both vertically or longitudinally arranged reinforcement members and horizontally or lateral arranged reinforcement members. The insert engages and retains both vertically or longitudinally and horizontally or laterally arranged reinforcement bars simultaneously.

The present invention is a reinforcement member positioning insert. This insert holds reinforcement members such as long steel reinforcing bars in a desired position with respect to a construction block or an assembly of construction blocks.

The insert comprises a means for securing the insert within a construction block opening or for securing the insert to the construction block. By this means the insert is fixable relative to the opening.

There are many types of construction blocks and the present invention is not limited to use with any particular type. A typical construction block is hollow with outside walls. The hollow space is open at the ends of the block. This hollow space is the opening of the construction block. A plurality of construction blocks is assembled into an assembly of construction blocks with the open ends of the construction blocks adjacent. The hollow space in an assembly of construction blocks is a continuous hollow space formed by the adjacent hollow spaces of the opening of all the blocks in the assembly of blocks.

The insert is also usable with assemblies of solid construction blocks—that is construction blocks that do not comprise an opening. The insert is also usable with assemblies comprising both solid construction blocks and construction blocks comprising opening.

It is possible for a plurality of construction blocks to be arranged into an assembly with a space or opening between them. The insert comprises a means for securing itself to the assembly so that it is fixed relative to the opening formed by the assembly. This is possible whether or not any of the construction blocks comprise their own opening.

The insert comprises a first stay. A stay is a device by with a reinforcement member is engaged and retained. A hole through the insert is a useful as a stay. The reinforcement member is held in position by the perimeter wall of the hole. A magnet fixed to the insert is a useful stay for reinforcement members that are steel reinforcement bars. The magnet attaches to the reinforcement member and holds it in position. Fork prongs fixed to the insert are useful stays.

The insert is suitable for use with reinforcement members or reinforcement members such as reinforcing rods, known as 'steels' or 'rebars'. The insert is also suitable for use with other reinforcing members known in the construction industry for holding an assembly of brick or blocks together and reinforcing the assembly.

Any type of stay that is capable, with the insert in use, of sideways engagement and retention of a reinforcement member is useable with this insert. It is appreciated that there are many mechanical variations with this capability for sideways engagement and retention.

The insert is portable and easily held in the hand. In use the insert is placed in position on a construction block or on an assembly of construction blocks or within an opening of a construction block or with within in an opening formed by an assembly of construction blocks. The insert comprises a means for fixing itself in this position once it is placed there by hand.

The insert has a first stay capable of sideways engaging and retaining a reinforcement member passing through the opening of the construction block. This is particularly useful where an assembly of construction blocks consists of stacked layers of construction blocks. The opening of each block in the stack is continuous with the opening of the blocks in the stack above and below it. The reinforcement member passes though the continuous opening in the stack. The insert engages with and retains this reinforcement member thereby holding it in a desired position within this opening of the construction block assembly.

The insert also may have a second stay. With the insert in use the second stay is capable of sideways engagement and retention of a second reinforcement member passing across the opening. Passing across the opening means traversing the opening or appears to traverse a cross section of the opening. From a view point external to the construction block or assembly of construction blocks the opening has an opening.

From the external view point the second reinforcement member traverses across the opening and is said to pass across the opening. The second reinforcement member does not have to enter the opening to pass across the opening.

The insert is placed in position by hand and engaged sideways with a reinforcement member by the hand held manipulation of the insert. The insert has its own means to retain the reinforcement member Preferably the means for retaining is the form of the insert. This form is compressible which results in the length of the insert being variable. This allows one insert to be used with a variety of construction blocks and assembly of construction blocks which have opening with a variety of opening openings.

The length of the insert is greatest when it is uncompressed. Uncompressed the insert spans a distance greater than the minimum distance between internal walls defining the opening.

The insert is compressed preferably by hand so as to shorten the insert. The compressed and shortened insert fits into the minimum distance between internal walls of the opening. The insert is resilient and returns to its uncompressed state if uncompressed.

A preferable means to secure the insert to the construction block is to compress the insert with hand force, place it between the internal walls of the opening, and release hand force compressing the insert. Upon release the insert, being resilient, will lengthen and become wedged against the internal walls of the opening. Thus the insert is wedge-able across the opening between the walls of the opening.

Preferably the form of the insert is a flexible resilient arch. The arch has distal ends which in use contact the walls of the opening. In use the arch is wedged between and against the walls of the opening. This fixes the insert to the construction block.

Preferably the distal ends are in the form of feet. In use there is friction between the feet and the walls of the opening in the construction block or assembly of construction blocks. This friction leads to a frictional force between the insert and the wall because the insert is resilient and the insert lengthens until the feet press against the walls. This friction force holds the insert in position in the opening.

A preferred method to place the arch into the opening and fix it to the construction block is to squeeze the distal ends of the arch together by hand. By compressing the insert in this way the insert is adapted to be placed between and against the internal walls of the opening. Upon release of the compressive force the distal ends, the resilient arch uncompresses and the distal ends spread apart until the distal ends press against the internal walls of the opening. The insert is thereby wedged within the opening and fixed to the construction block.

An alternative and equally preferable form of the insert is a compressible resilient board-like object. The board-like object has distal ends which use contact the walls of the opening. In use the board-like object is wedged between and against the walls of the opening. This fixes the insert to the construction block.

A preferred method to place the board-like object into the opening and fix it to the construction block is to squeeze the distal ends of the board-like object together by hand. By compressing the insert in this way the insert may be inserted between and against the internal walls of the opening. Upon release of hand force compressing the distal ends, the resilient board-like object uncompresses so the distal ends spread apart until the distal ends press against the internal walls of the opening. The insert is thereby wedged within the opening and fixed to the construction block.

An advantage of the arch form for the insert is that the insert may be relatively heavy and sturdy compared to the form of the insert that is board like. The reason is that it is relatively easy to bend by hand a long flexible arch to squeeze the distal ends together. It is relatively difficult to squeeze distal ends of board-like object together if the board-like object has the same thickness as a corresponding arch because the ends of the board-like object are squeezed together without bending the board-like object. An advantage of the board-like form for the insert is it is a relatively simple form compared to the arch form.

A preferred refinement of the board-like form of the insert is for the form to comprise a relatively stiff body and a pair of resilient and relatively compressible and resilient distal regions extending from the body to opposite ends of the board-like form.

Preferably these distal regions are feet. These distal regions, (feet), are in use wedged against the walls of the opening. An advantage of this refined board-like form is that the relatively stiff body is also sturdy for supporting the stays.

In a preferable form of the distal end regions they comprise a plurality of adjacent toes extending from the body to opposite ends of the insert. An advantage of these toes is that they are easily compressed by hand so as to shorten the length between the ends of the insert so that the insert is relatively easy to wedge by hand inside the opening.

In a preferable form of the insert with the toes, the toes are arranged side by side from shortest to longest. The toe with shortest length is adjacent to the toe with the next shortest length so that the lengths of each toe increase progressively from shortest to longest.

As the toes are located at each distal side, toes with equal lengths are at diagonally opposite ends of the insert.

In use the insert is inserted into an opening of a brick or block where the distance between the internal walls is farther apart than the span of the insert from toe tip to diagonal toe tip. There is no need to compress the distal ends of the insert together in order to insert the insert into the opening.

Once the insert is inserted into the opening the insert is easily twistable so as to rotate the insert by hand within the opening. As the insert is twisted, the shortest toes first come into contact with walls of the opening that are closer together than the span of the insert from toe tip to toe tip. Further twisting brings the next longest toes against the walls of the opening. An advantage of this form of the insert is that it is easily wedged against the walls of the opening by twisting it by hand.

The insert has either an arch form or a board-like form. Both forms of the insert benefit from the above described relatively compressible and resilient distal end regions with or without the above described toes.

As noted above the insert comprises stays which in use engage sideways with reinforcement members and retain the reinforcement member.

Preferably at least one of the stays comprises a pair of fork prongs forming a fork entrance for accepting the corresponding reinforcement member and retaining the reinforcement member between the fork prongs. An advantage of fork prongs is that a plurality of prongs can engage with a plurality of different reinforcement members within a single fork or within a plurality of forks.

Preferably at least one stay comprises an opening in the insert with an entrance for accepting the corresponding reinforcement member and retaining the reinforcement member within the opening. Preferably the body of the board-like insert comprises the opening. An opening within an insert with an arch form is easily preferable.

Preferably at least one stay comprises an edge defining a hole through the insert and an entrance to the hole for accepting the corresponding reinforcement member and retaining the reinforcement member within the hole. Preferably the edge is C shaped. This C shape has the advantage of a narrow opening serving as the entrance to the hole. The construction reinforcement member easily passes sideways through the narrow C shaped entrance. Once the reinforcement member is through the entrance and into C shaped hole defined by the edge, then the edge holds reinforcement within the opening.

Preferably the sideways engagement and retention is by a clip fitting. A clip fit is easily accomplished by spacing the distance between the fork prong tips slightly less than the sideways thickness of the reinforcement members. A clip fit is also envisaged by arranging the narrow C shape opening to be slightly less than the narrow C shape opening.

Preferably the insert comprises a stay fixed to the insert wherein the stay is a resiliently deformable C or D shaped protrusion on the insert.

Preferably, the first stay and second stay are arranged to engage with substantially orthogonal reinforcement members. An advantage of this arrangement is that a reinforcement member passing through the opening and reinforcement member passing across the opening are easily engaged and retained.

Some, but not all, construction block assemblies are arranged like a wall of stacked construction blocks. In such an arrangement the reinforcement members that pass through the opening are substantially vertical or longitudinal and the reinforcement members that pass across the opening are substantially horizontal or lateral.

The insert comprising a first stay and a second stay arranged to engage with substantially orthogonal construction members has an advantage. The insert engages simultaneously with vertical or longitudinal and horizontal or lateral reinforcement members. With the insert is wedged within an opening of a block it retains both vertical (or longitudinal) and horizontal (or lateral) reinforcement members simultaneously in respective positions and orientations within the opening.

In use the insert is fixed to the construction block by wedging the insert within an opening of the block. In use a reinforcement member is retained by the insert. Therefore in use the position and orientation of the reinforcement member is retained relative to the construction block.

Preferably the insert is arranged so that the first and second stays are arranged to hold the first reinforcement member against the second reinforcement member. Advantage is that a cross connection between these reinforcement members is achieved.

An advantage is that an insert or a plurality of inserts in use is wedged into opening of an assembly of construction blocks. The insert or inserts in use retain the position and orientation of a plurality of reinforcement members within the assembly of construction blocks. Concrete is poured into the opening and advantageously each insert retains the position and orientation of the reinforcement members as the concrete is poured. The concrete hardens and permanently fixes the inserts and reinforcement members within the construction assembly. Advantageously such an assembly of construction blocks with inserts retaining reinforcement members is strong. Preferably the insert is perforated to allow through-passage of concrete slurry to facilitate finishing the construction block assembly.

The invention therefore encompasses an assembly of construction blocks comprising the insert wedged within openings within the blocks and retaining reinforcement members as described herein.

The invention will now be described, by way of example only, with reference to the accompanying drawings in which:

DETAILED DESCRIPTION OF FIGURES

Figure 1:
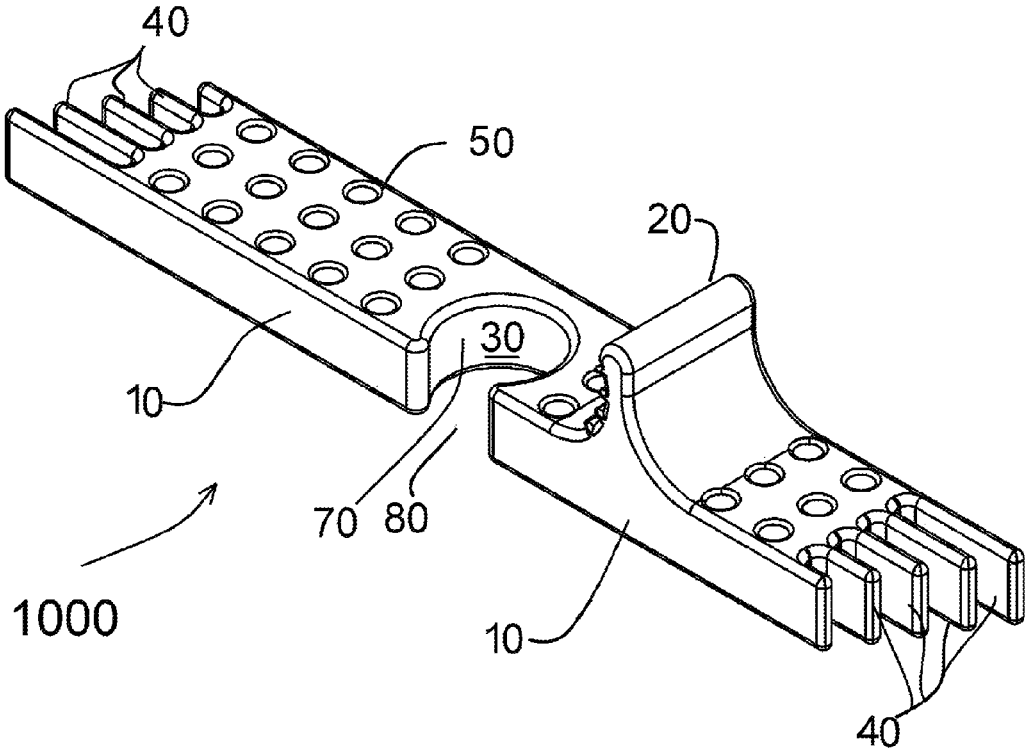
FIG. 1 is an isometric view of an insert.
Figure 2:
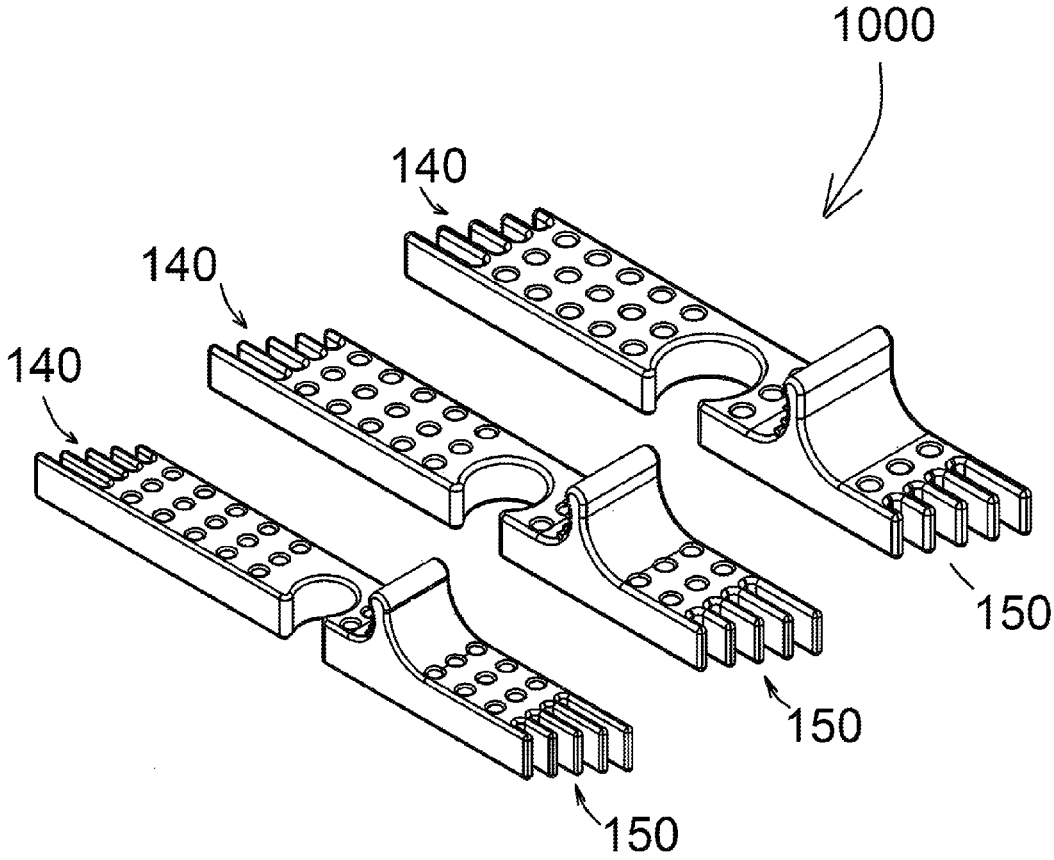
FIG. 2 shows isometric views of inserts of several sizes.
Figure 3:
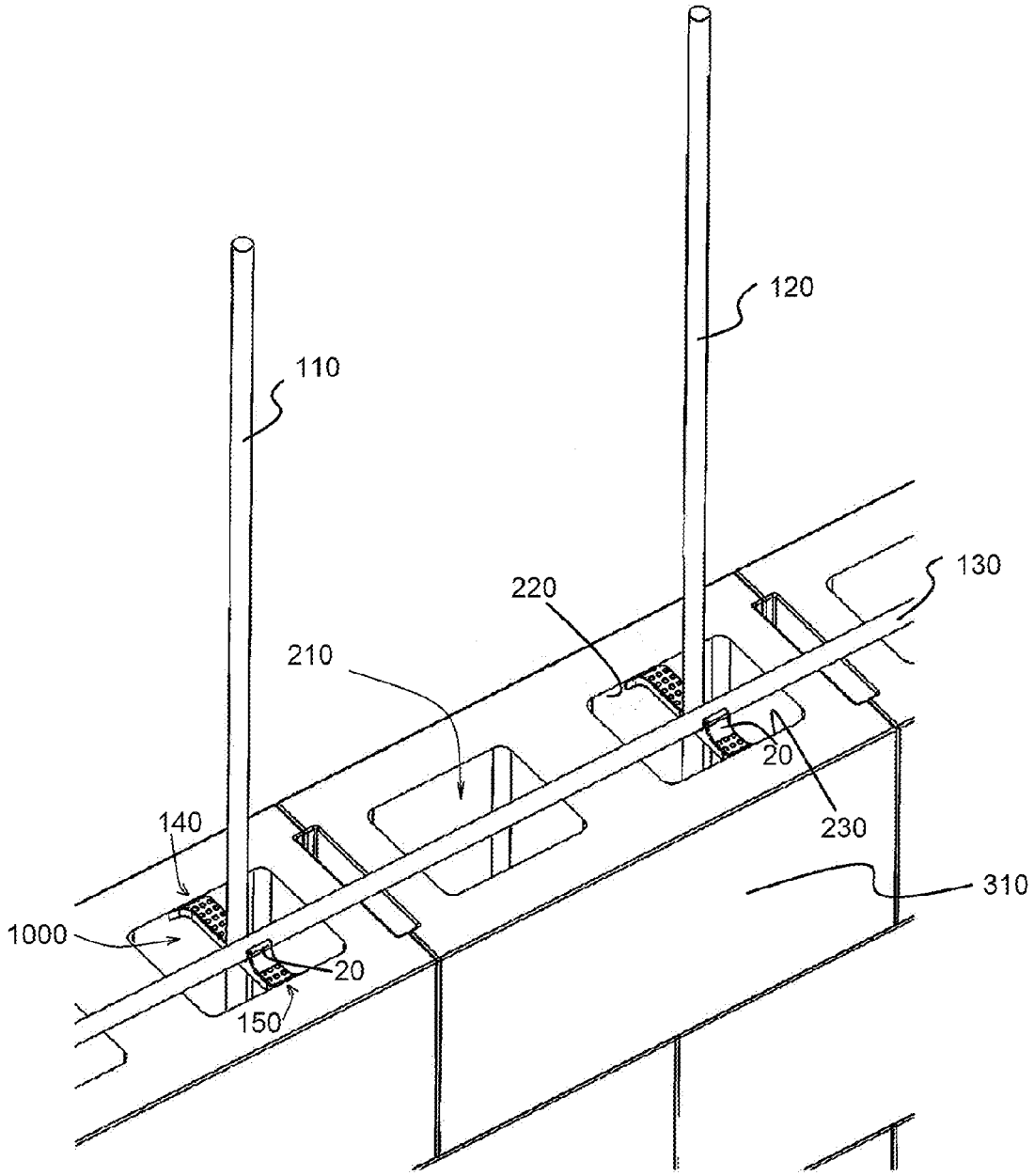
FIG. 3 shows an insert wedged within an opening of a construction block in a wall thereby retaining reinforcement members in preferred positions and orientations.
Figure 4A:
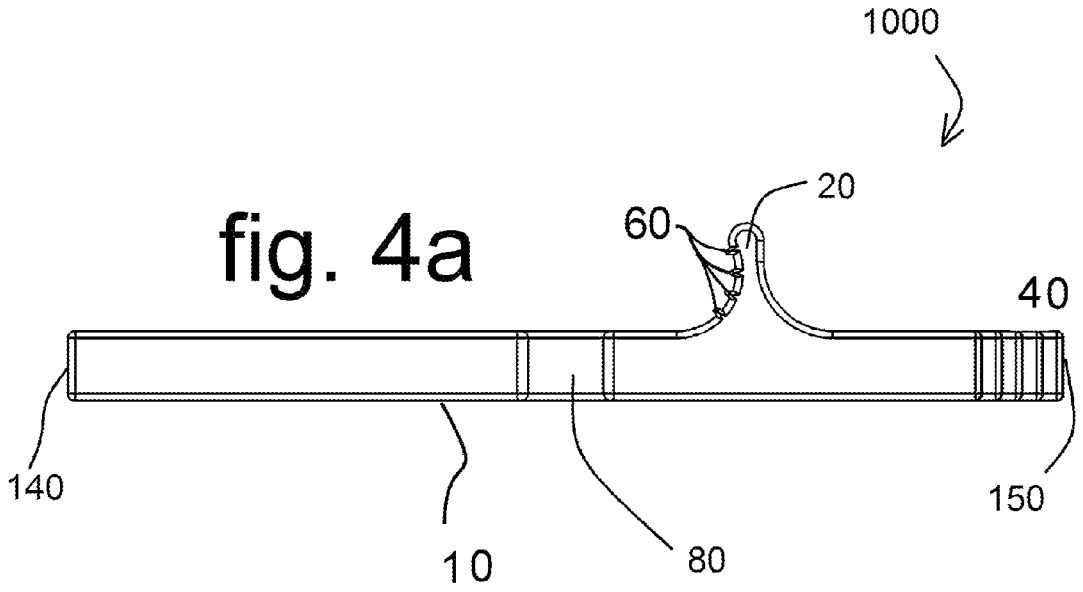
FIG. 4*a* is a right side view of the insert illustrated in FIG. 1.
Figure 4B:
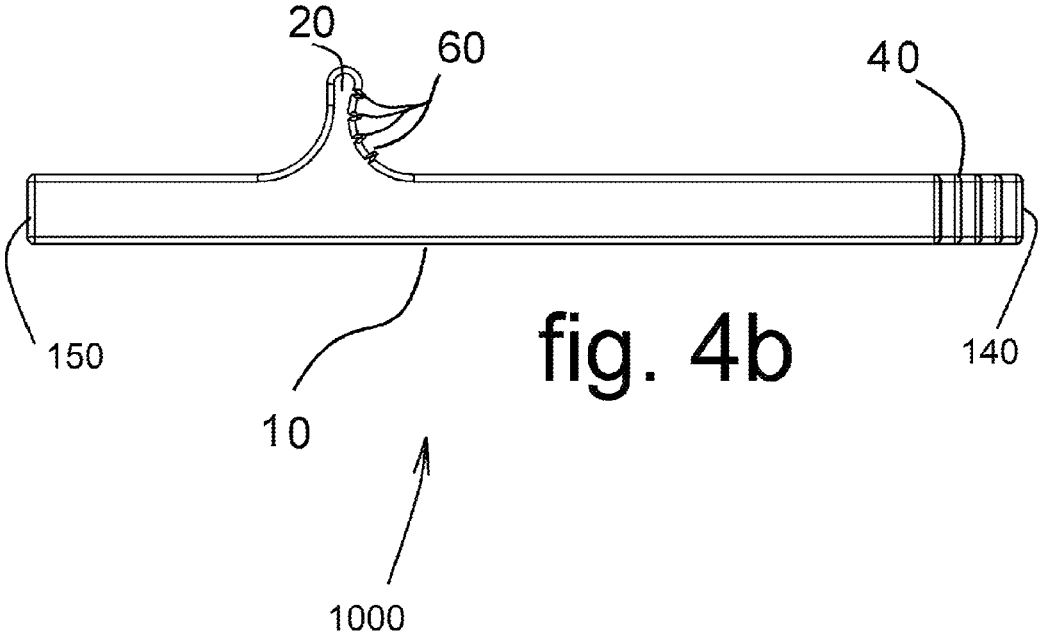
FIG. 4*b* is a left side view of the insert illustrated in FIG. 1.
Figure 5A:
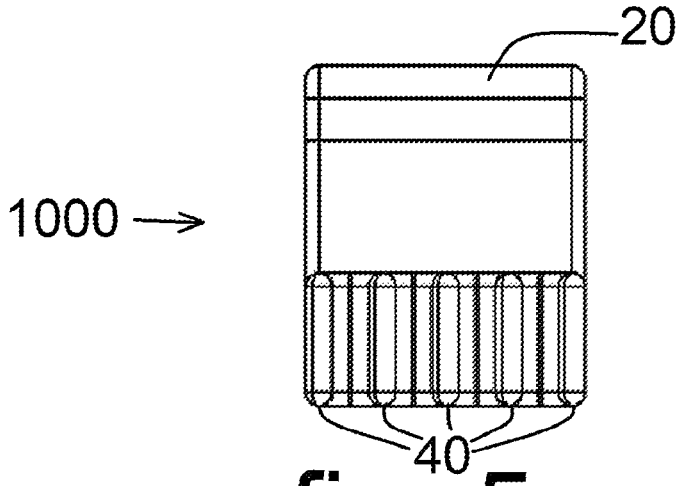
FIG. 5*a* is a front view of the insert illustrated in FIG. 1.
Figure 5B:
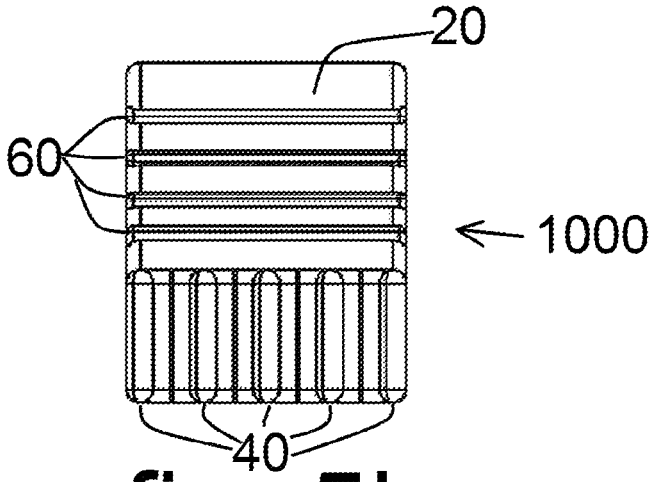
FIG. 5*b* is a rear view of the insert illustrated in FIG. 1.
Figure 6A:
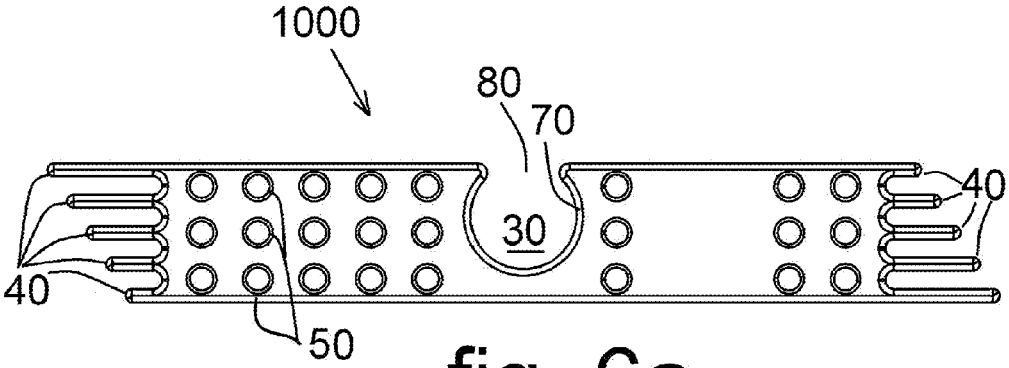
FIG. 6*a* is an underplan view of the insert illustrated in FIG. 1.
Figure 6B:
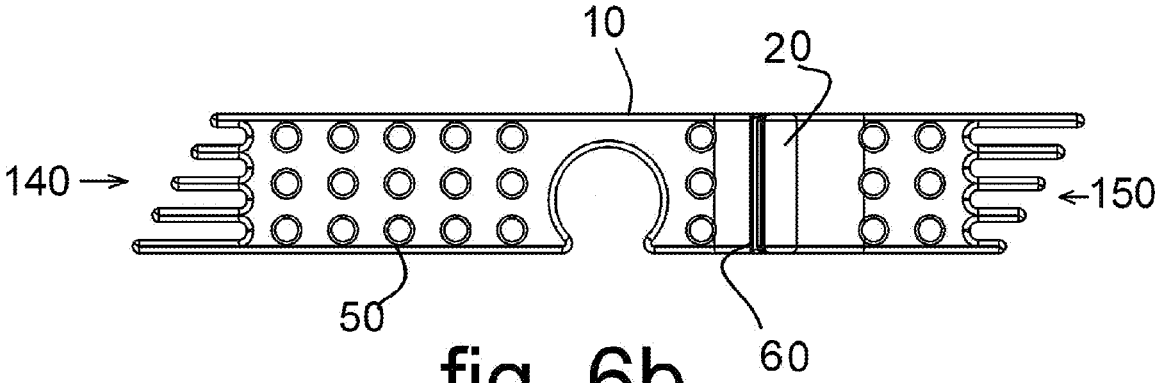
FIG. 6*b* is a plan view of the insert of the insert illustrated in FIG. 1.

FIG. 1 shows a one-piece resilient insert 1000 and FIG. 2 illustrates how the insert of FIG. 1 may be modified to provide differing lengths and widths. FIG. 3 shows two inserts 1000 supporting respective vertical reinforcement member 110, 120, and a transverse reinforcement member 130 within apertures 210 bricks 310 of a building structure.

The insert 1000 has first and second flexible feet 140, 150 at its distal ends to press on inner faces 220 and 230 within the openings 210 with sufficient friction to locate the reinforcement members 110, 120 and 130 respect to the brick 310 or building structure.

The insert 1000 has a first stay 30 shaped to receive and support the reinforcement members 110, 120 and 130. The first stay 30 engages sideways with longitudinal reinforcement members 110, 120 and maintains the position and orientation of the reinforcement member 130 over the openings 210.

The insert is formed from a resilient material and is capable of being flexed to vary its length. Thus the span between the toes 40 of the feet 140, 150 is variable to accommodate apertures 210 of different sizes.

As shown in FIGS. 1, 2, 3, and 4 the insert 100 has a mid section in the form of an elongate body 10. At the distal ends of the body 10 there are deformable portions defining the toes 40.

The body 10 has the first stay 30 located intermediate the feet 140, 150. At least the entrance of this stay deforms to allow entrance of the reinforcement member 110, 120 and reforms about said reinforcement members. Thereby the first stay 30 maintains the orientation and position of the reinforcement members 110, 120 within the opening 210 in the brick or block 310.

The first stay 30 has an edge 70 defining the lateral entrance 80 to a longitudinal hole through the insert 1000. The first stay 30 thus enables reinforcement members 110, 120 to pass longitudinally through the opening 210 to be received sideways through the lateral entrance 80 and thereby supported by the first stay 30.

In addition there is a second stay 20 in the form of a catch. The second stay 20 holds the second reinforcement member 130. The catch includes ribbing 60 visible in FIGS. 4*a* and 4*b*. The ribbing 60 minimise movement of the second reinforcement member as each rib is a barrier to movement of the second reinforcement member 130. The second stay provides deformable curvature over the second reinforcement member.

The second stay 20 is positioned close to the first stay 30. The first stay holds a first reinforcement member 110 or 120 in a vertical position and the second stay 20 holds a second reinforcement member 130 in a horizontal position. As the first stay 30 is close to the second stay 20 the first stay holds the first reinforcement member 110 or 120 against or proximate the second reinforcement member 130. As the first stay is vertical and the second stay is horizontal the two stays form a cross where insert 1000 holds them as shown in FIG. 3.

Perforations 50 pass through the insert 1000 and particularly through the body 10. These perforations 50 aid passage of poured concrete. In use the insert 1000 is usually left in situ in an assembly of construction components such a wall of blocks 310. Concrete is poured into the openings 210 and subsequently hardens around the reinforcement members 110, 120, and 130. The reinforcement members then reinforce the concrete and thereby the whole assembly of blocks. The perforations 50 allow concrete to flow through them. The perforations 50 lead to an insert that is integrated into the whole concrete and block structure.

Typically the body 10 length is 110 mm. The deformable portions 40 at the distal ends of each insert 1000 in the form of toes extend from the body 10 to further increase overall length.

Ideally the body 10 width is dependent upon stay size which is dependent on the reinforcement member diameter. Typically the insert 1000 is provided in various sizes to accommodate standard materials for example reinforcement members of 12 mm, 16 mm, and 20 mm diameters as shown in FIG. 2. It may be envisaged that the insert dimensions may be adapted to fit any type of masonry.

As may be appreciated from the Figures, reinforcement members are typically rods or wires known as rebar, reinforcement ties, and so forth in the construction trade. Note also that not all reinforcement members are rod or wire shaped and it may be appreciated that the shape and form of the stays 20, 30 are easily designed to accommodate reinforcement members of a myriad of shapes.

The invention has been described by way of examples only. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the claims.

The invention claimed is:

1. A reinforcement retainer in the form of a resilient insert proportioned to fit within an aperture in a construction component and defining a stay shaped to receive and support a reinforcement member in a final installation position within the aperture, said insert comprising a stiff body having flexible feet at its distal ends where a plurality of flexible toes of differing length extend to the tips of said distal ends to press on inner faces of the aperture to locate the reinforcement member in the final installation position whilst being capable of being flexed to accommodate apertures of different sizes.

2. A reinforcement retainer, according to claim 1, in which on each foot the toes are arranged side by side from shortest to longest so that toes with equal lengths are at diagonally opposite distal ends of the insert.

3. A reinforcement retainer, according to claim 1, comprising a second stay wherein the first stay is arranged to receive sideways a vertical reinforcement member passing longitudinally though the aperture in the construction component and the second stay is arranged to receive sideways a transverse reinforcement member passing laterally across the aperture whereby the first and second stays are arranged to hold the first reinforcement member against the second reinforcement member.

* * * * *